US005224913A

United States Patent [19]

Rodibaugh

[11] Patent Number: 5,224,913

[45] Date of Patent: Jul. 6, 1993

[54] SPRING EXERCISER

[76] Inventor: Albert C. Rodibaugh, 2770 Bertha St., Bethel Park, Pa. 15102

[21] Appl. No.: 881,232

[22] Filed: May 11, 1992

[51] Int. Cl.[5] ..... A63B 21/02

[52] U.S. Cl. ..... 482/124; 482/126

[58] Field of Search ..... 482/121, 124, 125, 126, 482/906, 122, 123, 128, 129, 130, 131, 79, 148, 74; 36/1, 136

[56] References Cited

U.S. PATENT DOCUMENTS 2,224,103 12/1940 Nilson .
2,498,006 2/1950 Ridill ..... 482/124
2,760,774 8/1956 Perez .
3,659,846 2/1972 Kanicki .
4,340,218 7/1982 Wilkinson .
4,815,731 3/1989 Suarez et al. .
4,909,506 3/1990 Smith .

FOREIGN PATENT DOCUMENTS 0434067 8/1935 United Kingdom ..... 482/124

*Primary Examiner*—Stephen R. Crow

[57] ABSTRACT

An improved exercising device for developing various parts of the user's body that can also be used in walking, jogging, and running. The Spring Exerciser comprises of a coil extension spring connected to locking clamps. These clamps can be attached to shoes for walking, running, exercising, or rehabilitation. They can also be attached to flexible straps which can be used in arm pulls or arm and leg exercises.

1 Claim, 2 Drawing Sheets

SPRING EXERCISER

BACKGROUND

1. Field of Invention

This invention relates to an improved spring exercising device which can also be worn while walking, jogging, and running.

2. Description fo Prior Art

Heretofore, spring exercising devices for the legs have been designed for use on the legs only and to be used in a stationary position.

Looking at EXERCISING APPARATUS in U.S. Pat. No. 2,224,103 to Nilson, Dec. 3, 1940, which is designed to be used on the legs while in a stationary position. The limited expansion on the elastic strips and the long length would make it impractical to use on the ankles when walking. The rubbing of the strap on the ankles while walking would make this apparatus uncomfortable.

FOOT EXERCISER in U.S. Pat. No. 2,760,774 to Perez, Aug. 28, 1956, comprises of a sandal type shoe with a spring on each sandal hooked to a platform. This is to be used only in a stationary position. Exercising the legs is accomplished by turning the toes toward each other pulling on the two side springs.

THE ELASTIC TYPE EXERCISING DEVICE in U.S. Pat. No. 3,659,846 to Kanicki, May 2, 1972, is designed to be used while anchored to an immoveable object. Using this device, you exercise one leg or arm at a time in a stationary position.

RESILIENT TYPE EXERCISER FOR SIMULATING CLIMBING in U.S. Pat. No. 4,340,218 to Wilkinson, Jul. 20, 1982, is an exercising device for simulating the action of climbing where the spring resistance is attached to the legs and at the other end to an immoveable object. This would require the user to remain in a fixed area.

EXERCISE DEVICE in U.S. Pat. No. 4,815,731 to Suarez et al, Mar. 28, 1989, is an exercising device for the arms and legs to be used in a stationary position. This exerciser would have to be pulled in a direction parallel to the spring to prevent the cuffs from rotating and injuring the limbs. Hence walking with this on the legs would irritate the ankles and to give the long stride necessary, the spring would need to be too long causing the wearer to trip over the spring.

And finally EXERCISE DEVICE in U.S. Pat. No. 4,909,506 to Smith, Mar. 20, 1990, is also designed to be used in a stationary position. Walking with the exercise device would cause your legs to be rubbed raw as the leg curved braces shifted while walking. The springs used are compression springs which need to be pushed together to create a resistance, hence this type of spring would not work if used in a walking type exerciser.

SUMMARY OF THE INVENTION

Accordingly, several objects and advantages of my invention are:

(a) to provide an exercising device that can be worn when walking, walking steps, jogging, and running to increase the health benefits of these exercises;

(b) to provide a universal device to be used for exercising most parts of the body—legs, arms, back, stomach, chest, neck, etc.;

(c) to provide a device to be worn during aerobics for a more concentrated workout;

(d) to provide a device to be used by persons during rehibilitation which can be used to exercise many parts of the body or used to increase the normal strain in moving the arms and legs.

Some advantages that my Spring Exerciser has over prior art are:

(a) its a universal exercising device that can be used to exercise most parts of the body;

(b) by adding a stronger or weaker flexible unit (spring or flexible material) the exercising device can be made more powerful or weaker to adapt to the intended use;

(c) the coil extension spring that I use has a low stress level because of its large diameter. This type of spring is able to be pulled a greater distance apart, enabling a long stride runner to use it.

(d) by attaching this device to the shoe you are able to walk, run or jog while feeling no discomfort. This eliminates the twisting and turning of ankle collars;

(e) the simple clamps that are attached to the spring gives this invention universal uses enabling it to be attached to several places on the shoe or when attached to flexible clamping straps used in many different ways;

(f) this device is made up of a flexible unit with a clamp on each end that can be attached to a flexible strap. This simple three piece unit would be inexpensive to produce lending it to a low retail price;

Further objects and advantages of my invention will become apparent from a consideration of the drawings and ensuing description of it.

DESCRIPTION OF PREFERRED EMBODIMENTS

Figure 1:
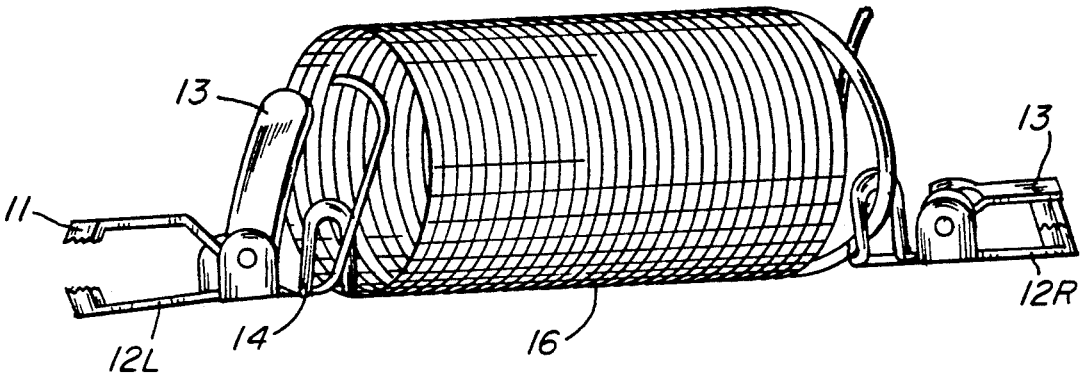
FIG. 1 shows a perspective view of my invention.

FIG. 1 shows a perspective view of a basic version of my spring exerciser. The spring exerciser comprises of a coil extension spring 16 which has locking clamps (12R, 12L) on each end of the spring. The locking clamps (12R, 12L) are attached to a coil extension spring at support point 14 on clamps. The clamps (12R, 12L) also have locking plates 13 that locks the clamps into place.

Figure 2:
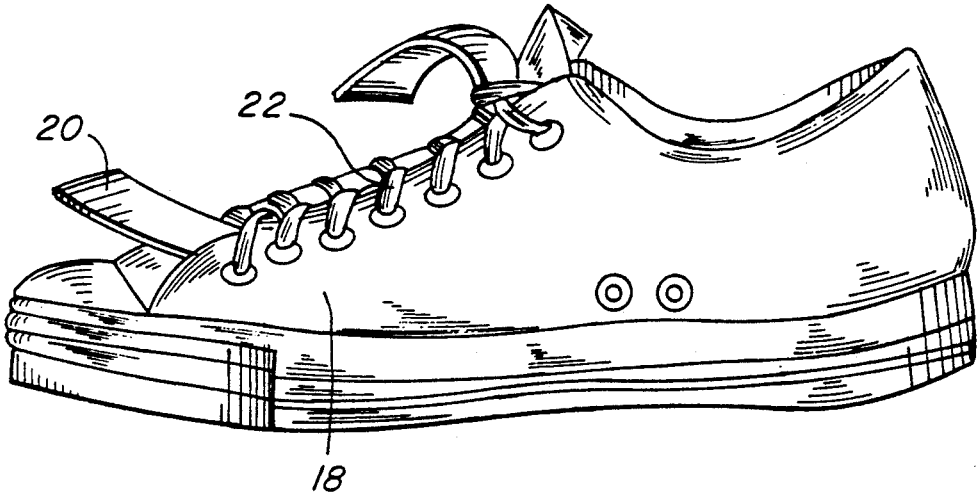
FIG. 2 shows a tennis shoe with flexible clamping strap under the shoe laces.

FIG. 2 shows a perspective view of a tennis shoe with flexible clamping strap 20 slid under shoe lace 22.

Figure 3:
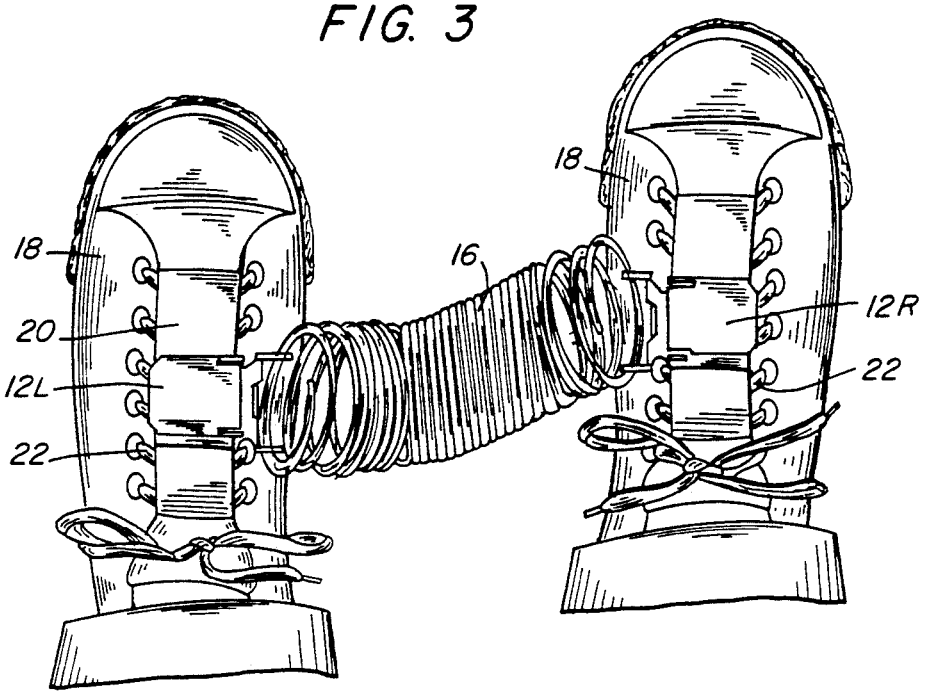
FIG. 3 shows a view from above of the Spring Exerciser attached to the shoes as right foot walks forward.

FIG. 3 shows a view from above of the spring exerciser's coil extension spring 16 connected to locking clamps (12R, 12L), which are locked to flexible clamping strap 20. Flexible clamping strap 20 is slid under the shoe laces 22 with its ends folded over to form a loop. Locking clamps (12R, 12L) are attached to the ends of this overlapping strap.

Figure 4:
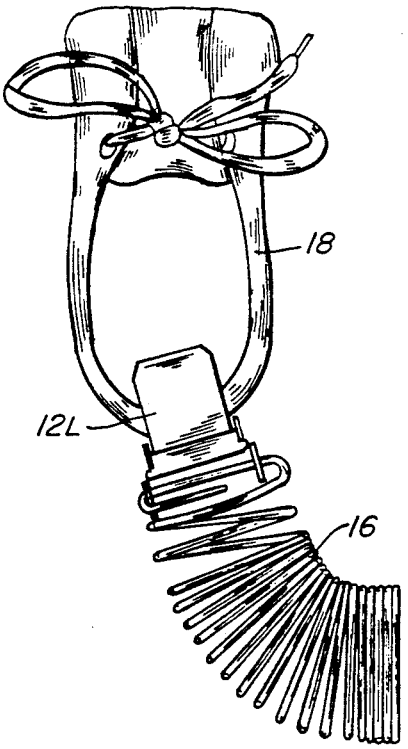
FIG. 4 shows a view above where the Spring Exerciser is clamped to the back of the shoe.

FIG. 4 shows a view from above of tennis shoe 18 with locking clamp 12L locked to the back heel portion of the shoe. Coil extension spring 16 is connected to locking clamp 12L.

Figure 5:
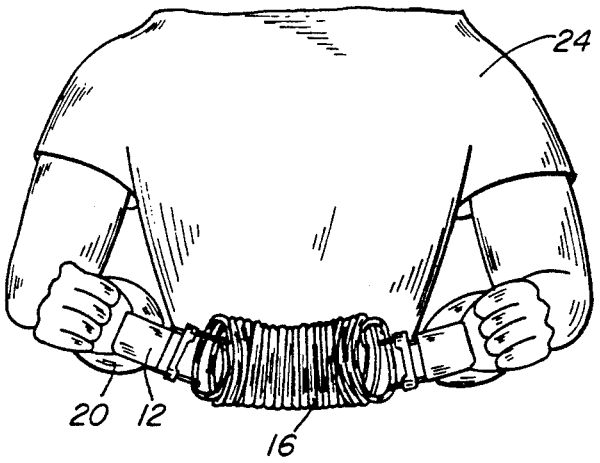
FIG. 5 shows an exerciser using my invention.

FIG. 5 shows athletic 24 holding flexible clamping straps 20, which have locking clamps 12R, 12L locked on. Locking clamps (12R, 12L) are connected to each end of coil extension spring 16.

OPERATION OF INVENTION

The Spring Exerciser is a device that can be used in many different ways. This universal exercising device can also be worn when walking, running and jogging. Referring to FIG. 3, the wearer needs to slip flexible clamping straps 20 under the shoe laces 22 and overlap the flexible clamping strap 20 on top of the shoe lace 22. Then take locking clamp 12 and slide it over the overlapped flexible clamping strap 20. By snapping lock plate 13 down the jaws 11 lock into flexible clamping strap 20.

With coil extension spring or similar expandable device connected to lock clamps, you are ready to walk, run or exercise.

Other options of connecting the locking clamps (12R, 12L) to the shoe is to clamp them to the back heel wall of the shoe as illustrated in FIG. 4. The locking clamps can also be attached to the side wall of the shoe or directly to the shoe laces.

The Spring Exerciser is not to be limited to use of the feet. By connecting locking clamps 12 to flexible clamping straps 20 it can be used as shown in FIG. 5. A further option would be to slip the foot into one clamping strap and hold the other in your hand to exercise.

Locking clamp 12 is a common clamp that is used on suspender. I found this to work best but it doesn't have to be limited to this type of clamp. I have taken the suspender clamp and bent the back bar 14, shown best in FIG. 1, to wrap around the wire end of coil extension spring 16 to hold the locking clamps (12R, 12L) in place.

SCOPE OF INVENTION

Thus the reader will see that my invention, the Spring Exerciser, is a multi-use exercise device. Not only can it be used for walking, jogging, and running but it can be used on the arms or arm and leg combination. It can be used when doing calisthetics, aerobics, and in rehibilitation. This is a total exercising unit.

This Spring Exerciser is a very simple device, comprising of a coil extension spring and locking clamps on the ends. The optional flexible clamping straps expand the uses of this universal exercising device. This would also be very simple and inexpensive exerciser to produce, which would allow it to be an inexpensive retail product.

Many other variations are possible for the Spring Exerciser. The coil extension spring can have a larger or a smaller diameter changing its pulling force. The larger the diameter the less stress is exerted on the spring when it is pulled apart. This large diameter allows the spring to be pulled further apart with little stress so a long legged person could use this exerciser while running or taking long steps. It doesn't have to be a metal spring; many other materials like a rubberized plastic would work. The suspender clamps could be replaced with hooks, wire, nylon straps or other type clips to anchor the exercise device. I found it better to anchor the device to the shoe when using it for exercising the legs, than to connect it to a strap wrapped around the ankle which would turn causing a brushburn on the skin. There also could be something anchored into the shoe like a small threaded eye bolt so the device could be hooked to this when in use.

While my above descriptions contain many specificities, these should not be construed as limitation of the scope of the invention, but rather as an exemplification of one preferred embodiment thereof. Many other variations are possible. For example the Spring Exerciser could be used in place of any of the prior-art patents that I cited. It could be used when walking on a treadmill, walking steps or walking throughout the day's normal activities, continuously exercising the body. I also noticed while walking on a treadmill that I was able to walk faster and longer with less effort while wearing my spring exercisers.

An exotic use would be to have the spring exerciser connected to your walking partner's foot and yours at the same time. Walking with the same foot forward (example right foot) would put your closest foot to your partner's closest foot in opposite directions, whereby exercising both with one unit. An additional exotic use would be for running faster. When running with Spring Exerciser on, you don't seem to notice the pulling force that expands the coil spring. What you benefit from is the recoiling of the spring which pulls your back leg forward making you run faster. It's like someone pushing you from behind to make you run faster with less effort.

I claim:

1. In combination with a pair of shoes tied with shoe laces, a pair of flexible clamp straps, each looped over the entire length of the shoe laces of each shoe, a pair of locking clamps, each looped over the central portion of said flexible clamp straps of each shoe, and a helical spring having ends connected to the ends of each of said locking clamps, whereby upon walking with said pair of shoes, the resulting tension of said helical spring will be resisted throughout the entire lengths of said shoe laces.

* * * * *